US006340962B1

(12) United States Patent
Konishi

(10) Patent No.: US 6,340,962 B1
(45) Date of Patent: Jan. 22, 2002

(54) PLANE TYPE DISPLAYING APPARATUS

(75) Inventor: Morikazu Konishi, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/459,879

(22) Filed: Dec. 14, 1999

(30) Foreign Application Priority Data

Dec. 16, 1998 (JP) ..... P10-357935

(51) Int. Cl.[7] ..... G09G 3/22
(52) U.S. Cl. ..... 345/75.2; 345/74.1; 315/169.3
(58) Field of Search ..... 345/73, 74.1, 75.1, 345/75.2, 76; 315/169.3, 169.1, 169.2

(56) References Cited

U.S. PATENT DOCUMENTS 5,909,203 A * 6/1999 Browning et al. ..... 345/75.2
5,920,154 A * 7/1999 Hush ..... 345/75.2
5,939,833 A * 8/1999 Song et al. ..... 345/75.2

* cited by examiner

*Primary Examiner*—Xiao Wu
(74) *Attorney, Agent, or Firm*—Rader, Fishman & Grauer PLLC; Ronald P. Kananen, Esq.

(57) ABSTRACT

A plane type display device having a plurality of electric field emitting type cathodes (K), a high-tension electrode which fixedly gives on a surface of the plurality of cathodes (K) a strong electric field forming a Schottky barrier capable of making possible electron emission from the plurality of cathodes (K), a two-dimensional MOS gate array which is connected to the plurality of cathodes (K) and controls presence or absence of the electron emission from the plurality of cathodes (K) and a fluorescent substance layer (P) made to brighten by bombarding of the electrons selectively emitted from among the plurality of cathodes (K), whereby in a plane type displaying apparatus comprising a plurality of electric field emitting type cathodes and a fluorescent substance layer made to brighten by bombarding of electrons emitted from a cathode selected out of the plurality of electric field emitting type cathodes, a plane type displaying apparatus which is capable of making lower a driving voltage for having the plurality of cathodes selectively emit the electrons, reducing power consumption as well as performing a high speed operation is obtained.

12 Claims, 12 Drawing Sheets

PLANE TYPE DISPLAYING APPARATUS

BACKGROUND OF THE INVENTION

1. Field of the Invention

The present invention relates to a plane type displaying apparatus equipped with an electric field emitting type cathode.

2. Description of the Related Art

In the following will be explained a conventional example of a plane type displaying apparatus equipped with a field emitting type cathode (emitter) with reference to FIG. 1 and FIG. 2. In FIG. 1 and FIG. 2, KK and G are respectively a plurality of cathode electrodes and gate electrodes (drawer electrode) of an equal width and an equal space forming an XY matrix and disposed like crossing and opposing each other through insulating layers Z. A is an anode electrode opposing the plurality of gate electrodes G at a predetermined space. A fluorescent substance layer P is coated on a surface (a lower surface is permissible) of the anode electrode A.

At crossing portions between the plurality of cathode electrodes KK and the plurality of gate electrodes G, circular holes H are bored and at the same time, cavities CV are provided to be connected with the holes H in the insulating layer Z. In the cavities CV, conic shape Spindt type field emission type cathodes (emitter) K are planted on the cathode electrode KK. The field emitter type cathode K is comprised of Mo, W, Cr or the like which will emit an electron by way of a tunnel effect when selectively applying an electric field of about 0.01V/Å~0, 1V/Å thereto. Then, a positional relationship between the hole H and the cathode K is set so that a vertex of the cathode K is positioned at a center of the aperture H.

These electrodes G, cathode electrodes KK, cathodes K, anode electrode A, fluorescent substance layer P and insulating layer Z are accommodated in a flat tube formed of glass and the like and the inside of the flat tube is made a vacuum. A fixed voltage, for example, a direct current voltage of 3 kV is applied to the anode electrode A. A direct current voltage of, for example, 100V from a scan driver SD is, in FIG. 1, successively and cyclically applied to the plurality of gate electrodes G from the upper side gate electrode G to the lower side gate electrode G. A voltage of 0V (for example, a voltage of 0V~10V is permissible) in response to an image signal is selectively applied to the plurality of cathode electrodes KK from the data driver DD.

As a result, at the crossing point between the gate electrode G to which the direct current voltage of 100V is applied and the cathode electrode KK to which the voltage of 0V is applied out of the plurality of gate electrodes G and the plurality of cathode electrodes KK, electric field emission (i.e., emissions of electrons) is started between the cathode K and the anode electrode A and an electron drawn out from the cathode K is bombarded on the anode electrode A by the gate electrode G, thereby resulting in luminescence of the fluorescent substance layer P.

In the plane type displaying apparatus, an image is displayed by collection of as one pixel, for example, 1000 pieces of the crossing points between the gate electrode G and the cathode electrode KK as one pixel. When the whole of fluorescent substance layer P is comprised of a white luminescing fluorescent substance layer, a monochrome plane type displaying apparatus can be obtained while when the fluorescent substance layer P is comprised of red, green and blue luminescing fluorescent substance stripes, each having a width of one pixel, a color plane type displaying apparatus can be obtained.

As for an example of the electric field emitting type A cathode (emitter) K, there are various kinds other than what is shown in FIG. 2 and one example of a part thereof will be explained with reference to FIG. 3. Meanwhile, A1, B1, C1 of FIG.3 are plan views of the cathodes and A2, B2, C2 of FIG.3 are cross-section views of the cathodes in A1, B1, C1 of FIG.3 respectively.

A1, A2 of FIG.3 show a pair of electrodes with one thereof being the cathode while the other being the gate electrode, and from an end portion of the cathode opposing the gate electrode, the electron is emitted to the anode electrode to be emitted graphically.

B1, B2 of FIG.3 show, for example, a cathode having a square aperture and the electron is emitted from an edge of the square aperture.

C1, C2 of FIG.3 show a concave cathode with a disc surface being a curve surface like forming, for example, a spherical surface and the electron is emitted from an edge of the concave.

As for an example of the electric field type emitting to cathode or emitter K, it may be formed of an MIM type electron emitting element which consists of metal/insulating layer/metal.

In the plane type displaying apparatus explained with respect to FIG. 1 and FIG. 2, presence or absence of discharge luminescence is carried out by presence or absence of application of respective predetermined voltages to the cathode (emitter) and the gate electrode (drawer electrode). Therefore, since it is necessary to apply a strong electric field (for example, 0.05V/Å) to the cathode forming a selected pixel every time the pixel is selected, that is, control of the electron emission at a time of selection/non-selection of the pixel is carried out by the electric field, a driving voltage becomes high when the pixel is selected, thereby incurring a problem in respect to a high speed operation as well as power consumption.

SUMMARY OF THE INVENTION

In view of such points, the present invention is, a type of displaying apparatus having a plurality of electric field emitting type cathodes and a fluorescent substance layer which is made to brighten by bombarding of the electron emitted from of the electric field emitting type cathode selected from among the plurality of electric field emitting type cathodes, to provide a plane type displaying apparatus which can lower a driving voltage for having the plurality of electric field type cathode selectively emit the electron, reduce the power consumption as well as perform the high speed operation.

Also, the present invention is in the plane type displaying apparatus having an electric emitting type cathode group wherein pixels, each of them consisting of electric field emitting type cathodes disposed in a matrix of m rows by n columns (however, m, n are integers equal to or larger than 1) are disposed in a matrix of M rows by N columns (however, M, N are integers equal to or larger than 2) and a fluorescent substance layer made to brighten by bombarding of the electron emitted from the electric field emitting type cathode at every pixel in the electric field emitting type cathode group, to provide a plane type displaying apparatus which can lower the driving voltage for having the electric field type cathodes group selectively emit the electron at every pixel, reduce the power consumption as well as perform the high speed operation.

A plane type displaying apparatus according to a first present invention comprises a plurality of electric field emitting type cathodes, a high-tension electrode which fixedly gives a strong electric field forming a Schottky barrier capable of making possible emitting electrons from the plurality of electric field emitting type cathodes to a surface of the plurality of electric field emitting type cathodes, a two dimensional MOS gate array which is connected to the plurality of electric field emitting type cathodes and controls presence or absence of the electron emission from the plurality of electric field emitting type cathodes, and a fluorescent substance layer made to brighten by bombarding of the electrons selectively emitted from among the plurality of electric field emitting type cathodes.

According to the first present invention, the high tension electrode fixedly gives the strong electric field forming the Schottky barrier capable of making possible the electron emission from the plurality of electric field type cathodes to the surfaces of the plurality of electric field type cathodes, the two-dimensional MOS gate array controls the presence or absence of the electron emission from the plurality of electric field type cathodes and the fluorescent substance layer is made to brighten by the bombarding of the electrons selectively emitted from among the plurality of electric field type cathodes.

DESCRIPTION OF THE PREFERRED EMBODIMENTS

Figure 1:
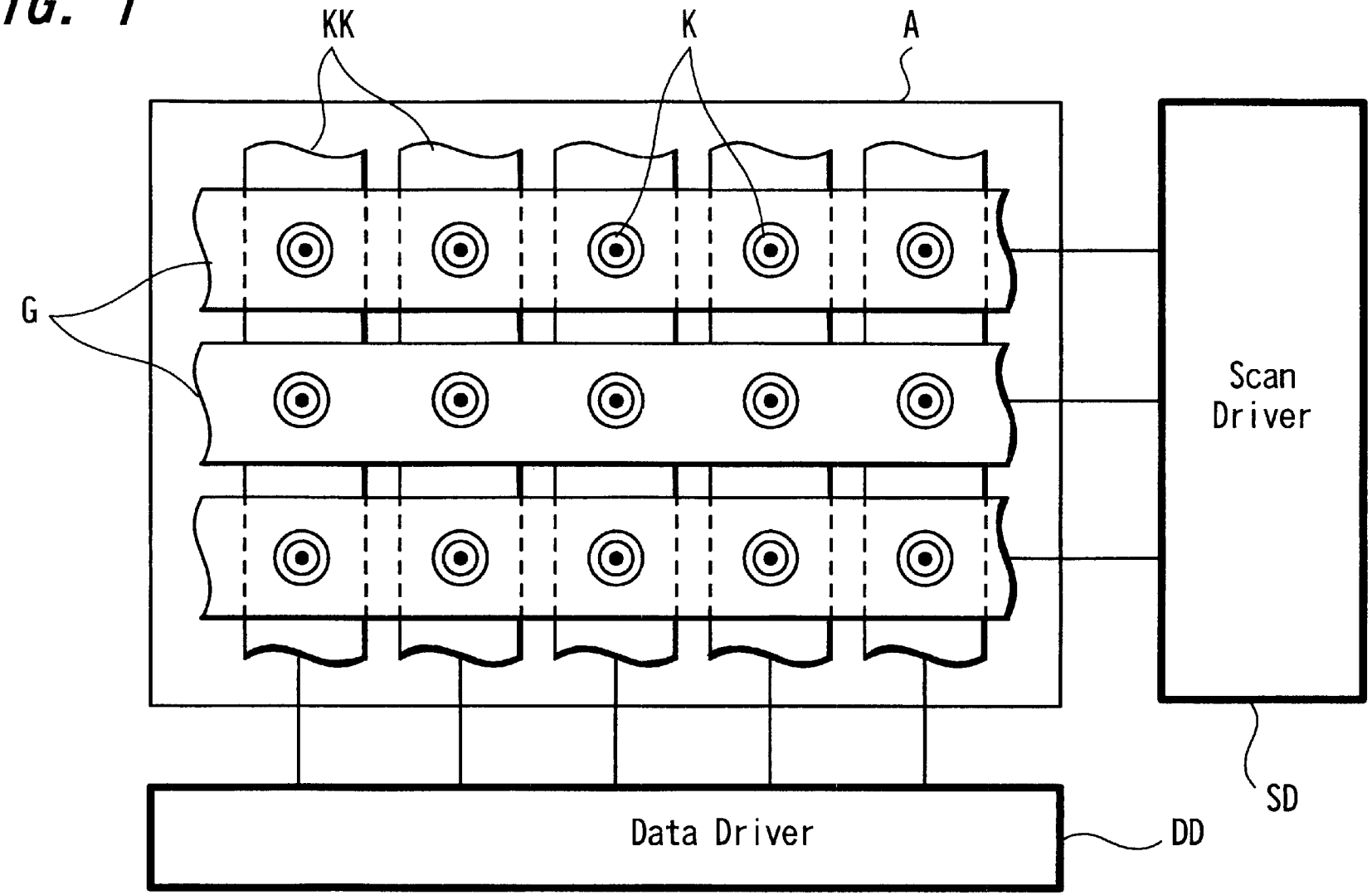
FIG. 1 is a block diagram showing a conventional plane type displaying apparatus.

A first aspect of the present invention is a plane type displaying apparatus comprising a plurality of electric field emitting type cathodes, a high-tension electrode which fixedly gives a strong electric field forming a Schottky barrier capable of making possible electron emission from the plurality of electric field emitting type cathodes to surfaces of the plurality of electric field emitting type cathodes, a two-dimensional MOS gate array which is connected to the plurality of electric field emitting type cathodes and controls presence or absence of the electron emission from the plurality of electric field emitting type cathodes, and a fluorescent substance layer made to brighten by bombarding of the electron emission selectively emitted from among the plurality of electric field emitting type cathodes.

A second aspect of the present invention is a plane type displaying apparatus comprising an electric field emitting type cathodes group wherein pixels, each of them consisting of electric field emitting type cathodes disposed in a matrix of m rows by n columns (however, m, n are integers equal to or more than 1) are disposed in a matrix of M rows by N columns (however, M, N are integers equal to or larger than 2), a high-tension electrode which fixedly gives a strong electric field forming the Schottky barrier capable of making possible the electron emission from the respective electric field type cathodes to the surfaces of the respective electric emitting type cathodes forming the electric field emitting type cathodes group, the two-dimensional MOS gate array consisting of the MOS gates to drains of which the electric field emitting type cathodes forming the electric field emitting type cathodes group are connected respectively, a scan driving means which successively and cyclically applies, at every row in M rows, a pulse voltage to gates of respective MOS gates connected to the respective-electric field emitting type cathodes in M rows of pixels, an image data driving means which, in synchronism with the pulse voltage generated by the scan driving means, simultaneously and selectively applies, at every column in N columns, a low voltage to sources of respective MOS gates connected to the respective electric field emitting type cathodes in N columns of the pixels depending on an image to be displayed and a fluorescent substance body made to brighten by the bombarding of the electrons selectively emitted from among the electric field cathodes at every pixel.

A third aspect of the present invention is, in the plane type displaying apparatus of the first present invention, a plane type displaying apparatus in which the high-tension electrode is an anode electrode wherein the fluorescent substance layer is formed.

A fifth feature of the present invention is, in the plane type displaying apparatus of the first present invention, a plane type displaying apparatus in which the high-tension electrode is a drawer electrode provided in the vicinity of the plurality of electric field emitting type cathodes.

A fifth feature of the present invention is, in the plane type displaying apparatus of the first present invention, a plane type displaying apparatus in which a shield electrode is provided in the vicinity of the plurality of electric field emitting type cathodes.

A sixth aspect of the present invention is, in the plane type displaying apparatus of the fifth present invention, a plane type displaying apparatus in which a voltage nearly equal to a low voltage selectively applied to the plurality of the electric field emitting type cathodes or lower than the low voltage is made to be applied to the shield electrode.

A seventh aspect of the invention is, in the fifth plane type displaying apparatus of the fifth present invention, a plane type displaying apparatus in which a voltage nearly equal to a low voltage selectively applied to the plurality of the electric field emitting type cathodes or lower than the low voltage is made to be applied to the shield electrode when at least the MOS gate is OFF.

An eighth aspect of the present invention is, in the plane type displaying apparatus of the second present invention, a plane type displaying apparatus in which the high-tension electrode is an anode electrode wherein the fluorescent substance layer is formed.

A ninth aspect of the present invention is, in the plane type displaying apparatus of the second present invention, a plane type displaying apparatus in which the high-tension electrode is a drawer electrode provided in the vicinity of the plurality of electric field emitting type cathodes.

A tenth feature of the present invention is, in the plane type displaying apparatus of the second present invention, a plane type displaying invention in which a shield electrode is provided in the vicinity of the plurality of electric field emitting type cathodes.

An eleventh feature of the present invention is, in the plane type displaying apparatus of the tenth present invention, a plane type displaying invention in which a voltage nearly equal to a low voltage selectively applied to the plurality of the electric field emitting type cathodes or lower than the low voltage is made to be applied to the shield electrode.

A twelfth aspect of the present invention is, in the plane type displaying apparatus of the tenth present invention, a plane type displaying apparatus in which a voltage nearly equal to a low voltage selectively applied to the plurality of the electric field emitting type cathodes or lower than the low voltage is made to be applied to the shield electrode when at least the MOS gate is OFF.

Figure 4:
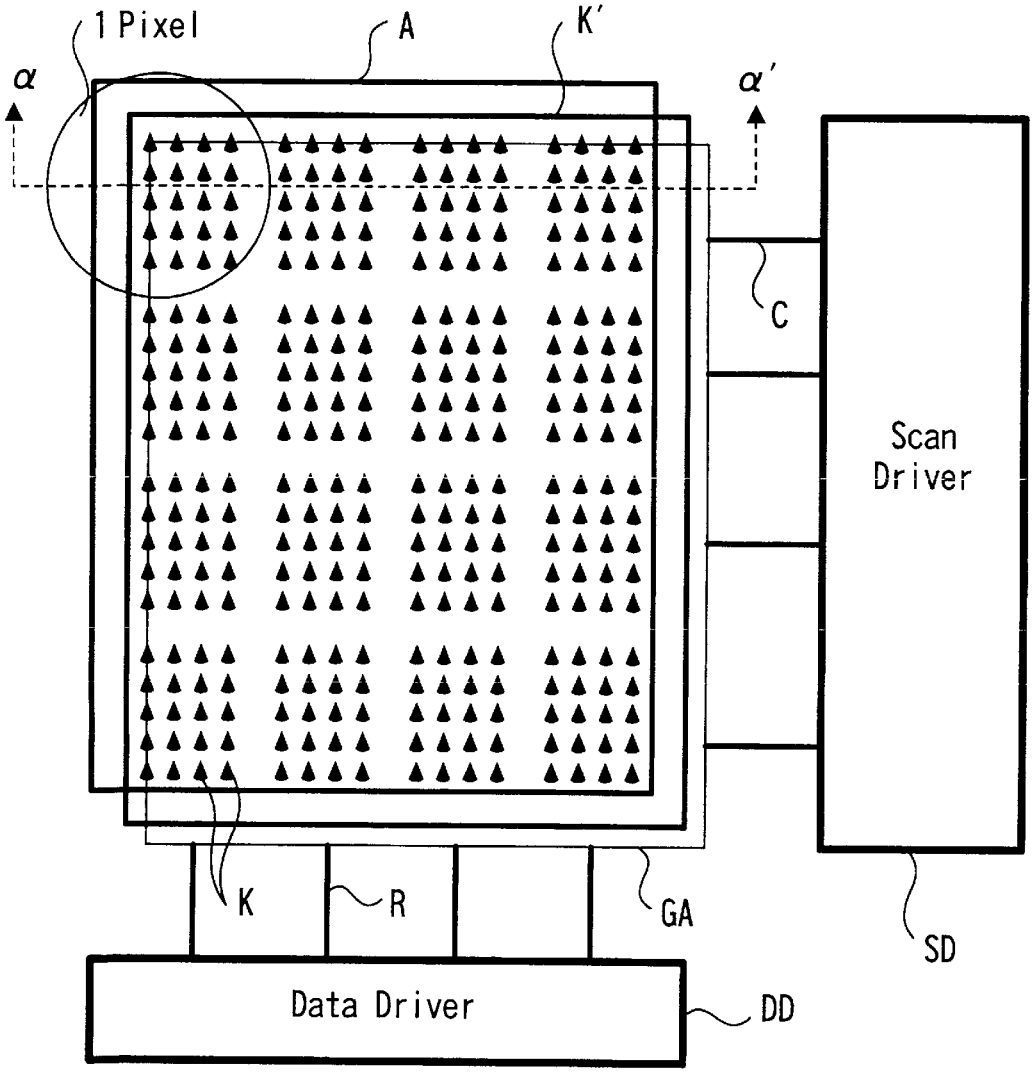
FIG. 4 is a block diagram showing a plane type displaying apparatus of a concrete example according to embodiment of the present invention.
Figure 5:
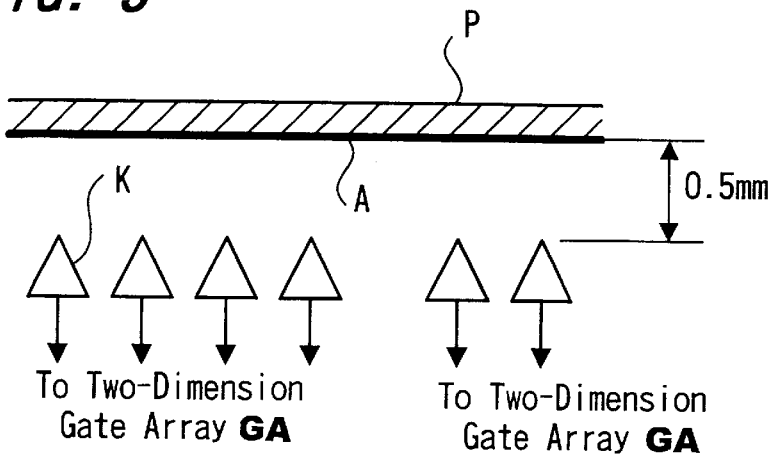
FIG. 5 is a cross-section view taken on line α–α' of FIG. 4 showing an electrode in the concrete example 1.
Figure 6:
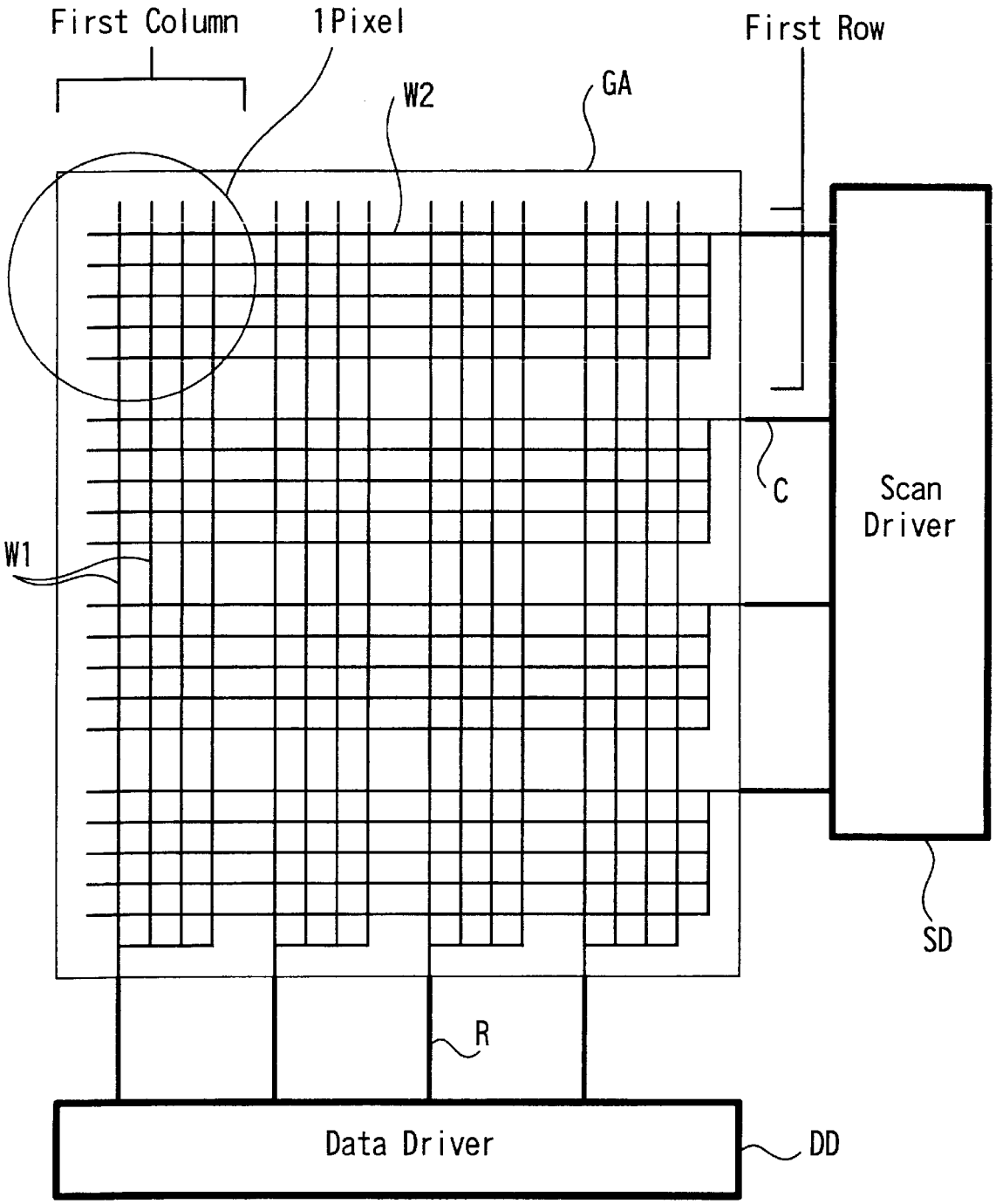
FIG. 6 is a block diagram showing a gate array in the concrete example 1.

Next, a plane type displaying apparatus of an concrete example 1 according to an embodiment of the present invention will be explained with reference to FIG. 4~FIG. 10. First of all, in referring to FIG. 4 and FIG. 5 showing a cross-section of an electrode taken on line α–α' thereof, A is an anode electrode and opposing this, a cathodes group K' are provided. A fluorescent substance layer P is deposition-formed on an upper surface (but a lower surface is permissible) of the anode electrode A. When a space between a tip end of each of the cathodes (the electric field emitting cathodes) K forming the cathodes group K' and the anode electrode A is made, for example, 0.5 mm, by applying a direct current voltage (i.e., fixed voltage) of 3 kV to the anode electrode A to give a strong electric field to all of the cathodes K forming the cathode group K', the Schottky barrier of all of the cathodes K is made low so that the electron emission is made possible. Then, presence or absence of the electron emission from each of the cathodes K is controlled by MOS gates respectively provided at all of the cathodes K. An assemblage of these MOS gates is called a two-dimensional MOS gate array GA. When the electron emission is carried out from the cathodes K, the electrons bombard the anode electrode A and the part of the fluorescent substance layer is made to luminesce.

The cathode group K' are formed of a number of the cathodes K of, for example, a conic shape spinet type disposed in, for example, a matrix. In FIG. 4, for example, 25 pieces×40 pieces=1000 pieces of the cathodes K are practically made one pixel, but, here, for example, 4 pieces×5 pieces of the cathodes K are made one pixel for simplification of an explanation and graphic showing. Then, one piece of a picture screen is comprised of pixels in M rows by N columns (however, M, N are integers equal to or larger than 2). Meanwhile, in FIG. 7, a pixel at the 1st row and the 1st column is representatively shown.

Figure 7:
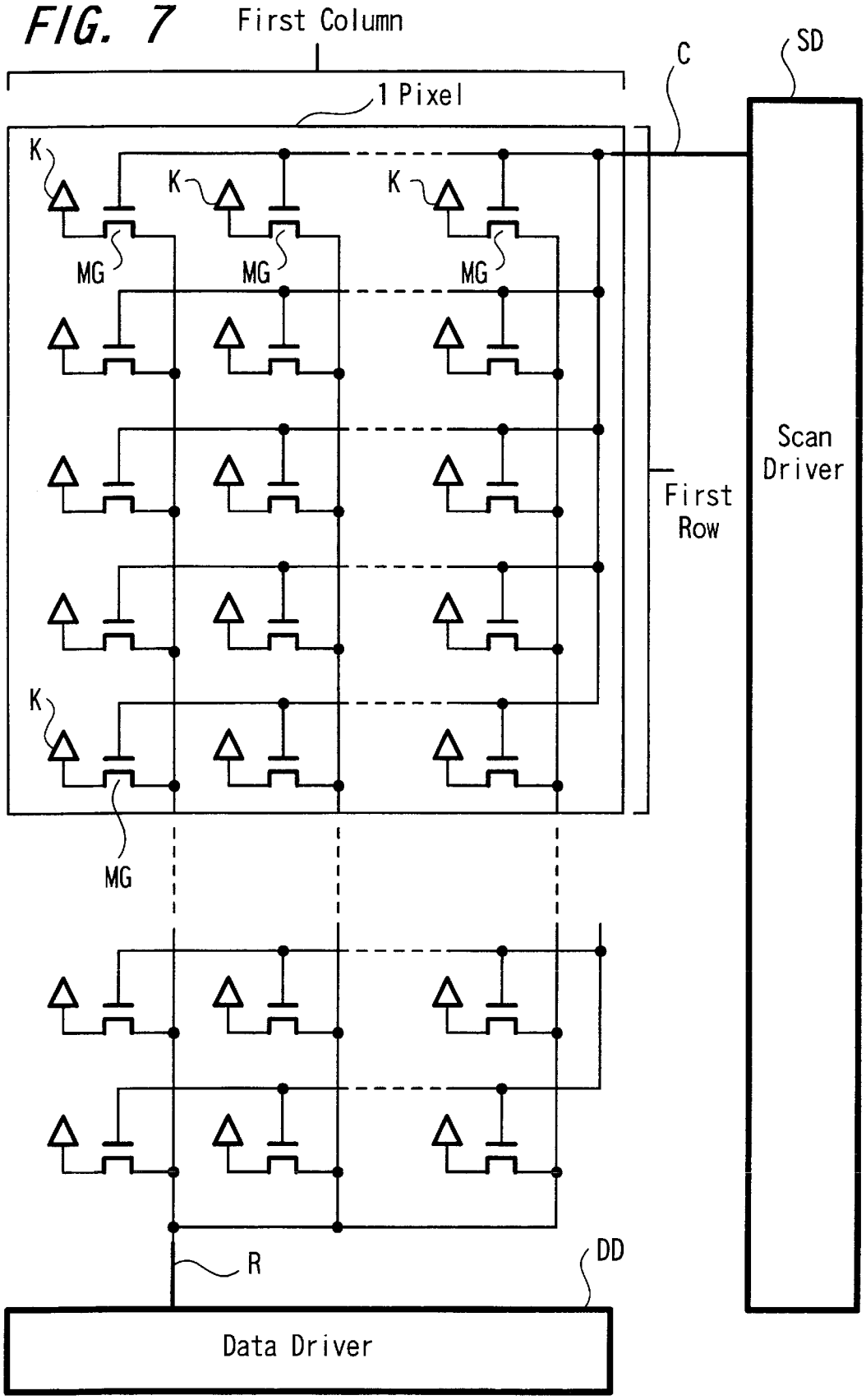
FIG. 7 is a block diagram showing a detail of the gate array in the concrete example 1.
Figure 8:
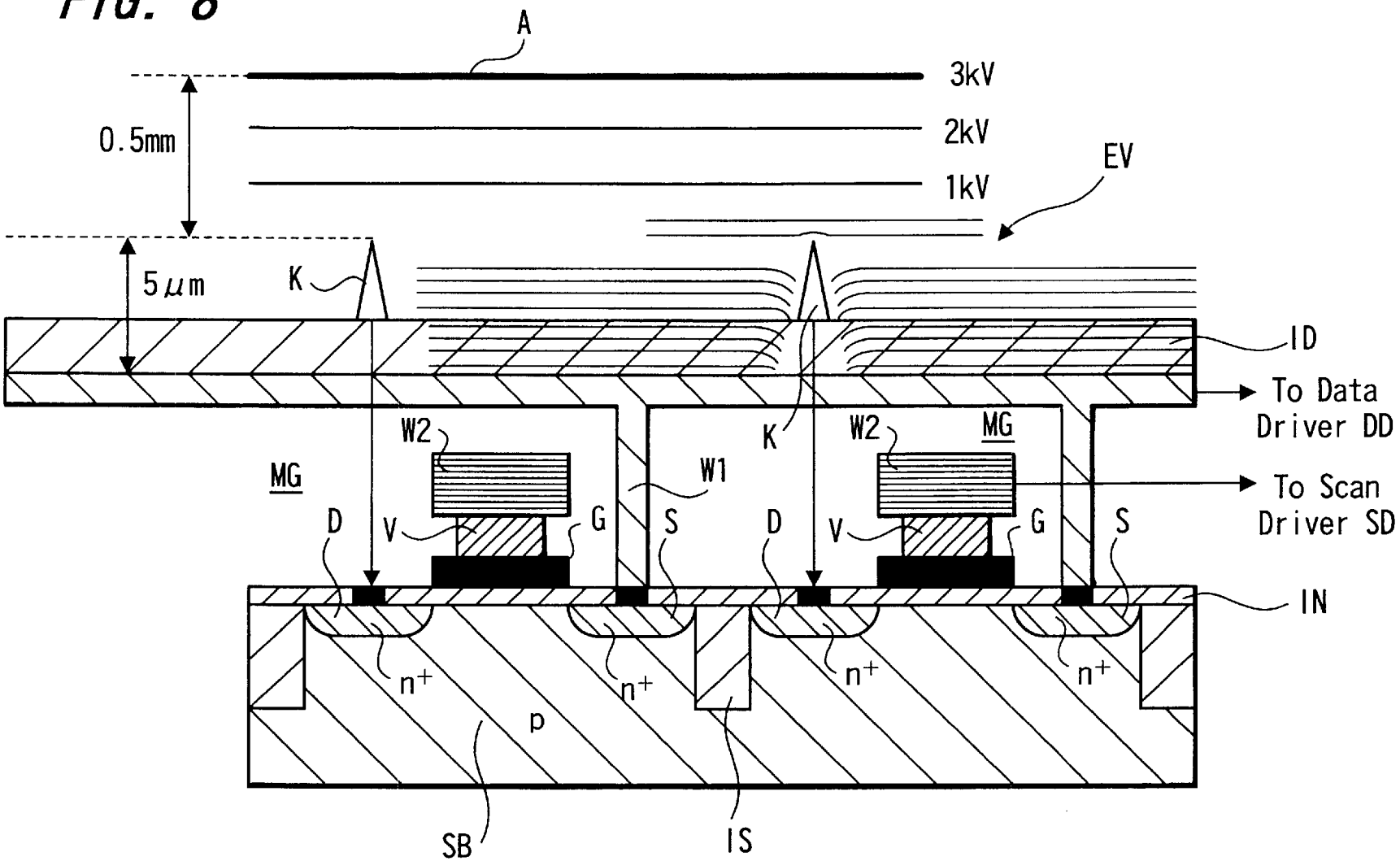
FIG. 8 is a cross-section view showing a structure in the vicinity of an MOS gate and a distribution of an electric potential in the vicinity of a cathode, in the concrete example 1.

Each of cathodes K is, as shown in FIG. 7 and FIG. 8, connected to a drain D of each of MOS gates, or MG {gates comprised of MOS (metal oxidized film semiconductor) field-effect transistors} of, for example, an n channel (of course, a p channel is permissible) of the gate array GA. Then, respective sources of the MOS gates MG in every 4 columns including respective pixels are commonly connected through a wiring W1 (FIG. 6, FIG. 8) and connected to a data driver DD through a column line R. Meanwhile, as shown in FIG. 8, an inter layer insulating film ID is formed on the wiring W1 and respective cathodes K are planted on the inter layer insulating film ID.

Also, respective gate electrodes G of the MOS gates MG in every 5 rows are commonly connected by a wiring W2 (FIG. 6, FIG. 8) through via holes (VIA HOLE) V (FIG. 8) and connected to a scan driver SD through a row line C.

In FIG. 8, SB is a p-type substrate of the MOS gate array GA, that is, one wherein a number of the MOS gates MG are formed while ID is an element separating region for separating the respective MOS gates MG. The drain (drain region) D and the source (source region) S are an n+ type region. IN is an insulating layer ($SiO_2$ layer) formed on an upper surface of the substrate SB. A gate (gate electrode) G is formed on the insulating layer IN between the drain D and the source S.

Next, operations of the plane type displaying apparatus of the concrete example 1 will be explained. To the surfaces of all the electric field emitting type cathodes K forming the cathodes group K' is applied an electric field of, for example, about 0.1 V/Å at the minimum by the anode electrode A. The scan driver SD cyclically and successively applies a pulse voltage with, for example, a crest value of 5V to a plurality of row lines C in the upward side to the downward side. As a result, the respective MOS gates MG in which the pulse voltage with a crest value of 5V is applied to the gate G become an ON state, and the data drive DD applies, in synchronism with the pulse voltage in selectively and applies an 0 voltage (ground voltage) to each pixel through each of the column lines R depending on an image to be displayed and a ground electric potential is given to the sources of the whole MOS gates MG of the selected pixels. Consequently, electrons are emitted by at least more than one cathode K of the selected pixels to bombard the anode electrode A, thereby resulting in the bombarded part of the fluorescent substance layer P being made to luminesce. At this time, a discharge current between the anode electrode A and the cathode K becomes an operation in a saturated region of voltage-current due to a rectification action of the MOS gate (MOS transistor) MG and is restricted to a constant current. As a result, destruction of the cathode K due to an excess current can be avoided.

Figure 10:
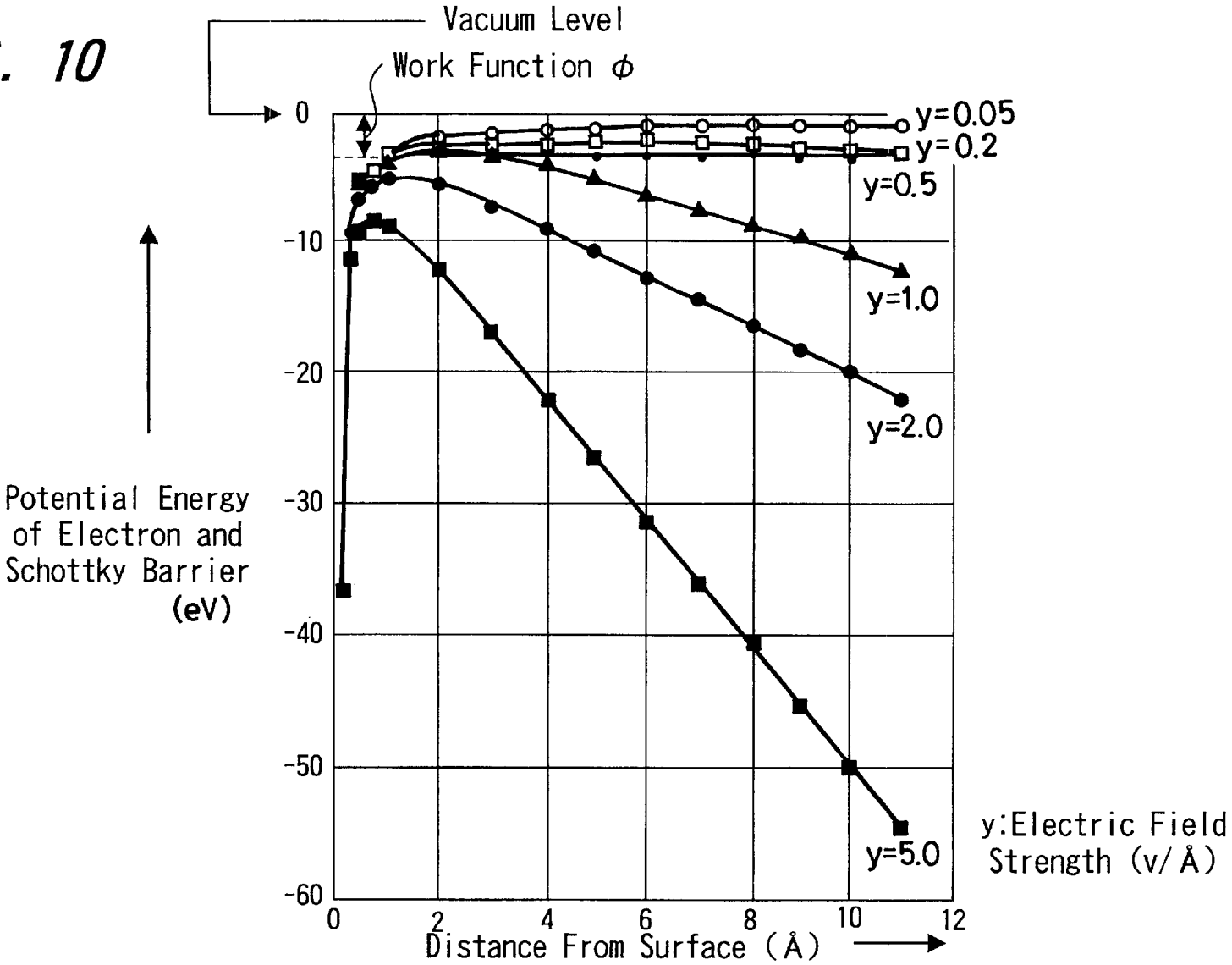
FIG. 10 is a characteristic curve diagram showing a potential energy of an electron and an electric field dependency of a Schottky barrier.

FIG. 10 shows characteristic curves of potential energy of an electron as well as of the Schottky barrier (eV) relative to a distance (Å) from the cathode electrode K when an electric field strength y (V/A) applied to the cathode K is varied to 0.05, 0.2, 0.5, 1.0, 2.0, 5.0. Meanwhile, Ø shows a work function of the cathode K from a vacuum level. Practically, the value by subtracting the work function Ø from the potential energy leaves the Schottky barrier but, here, the curve of the potential energy and the curve of the Scottky barrier are graphically shown by superimposing each other in order to simplify an explanation as well as a graphic representation. Also, the work function Ø shows the Schottky barrier when the electric field is 0 and is a constant value depending on the material of the cathode K. As for the material of the cathode K when the work function Ø is 3~4 eV, there are Mg, Cu, Mo, C, Si and the like.

Figure 2:
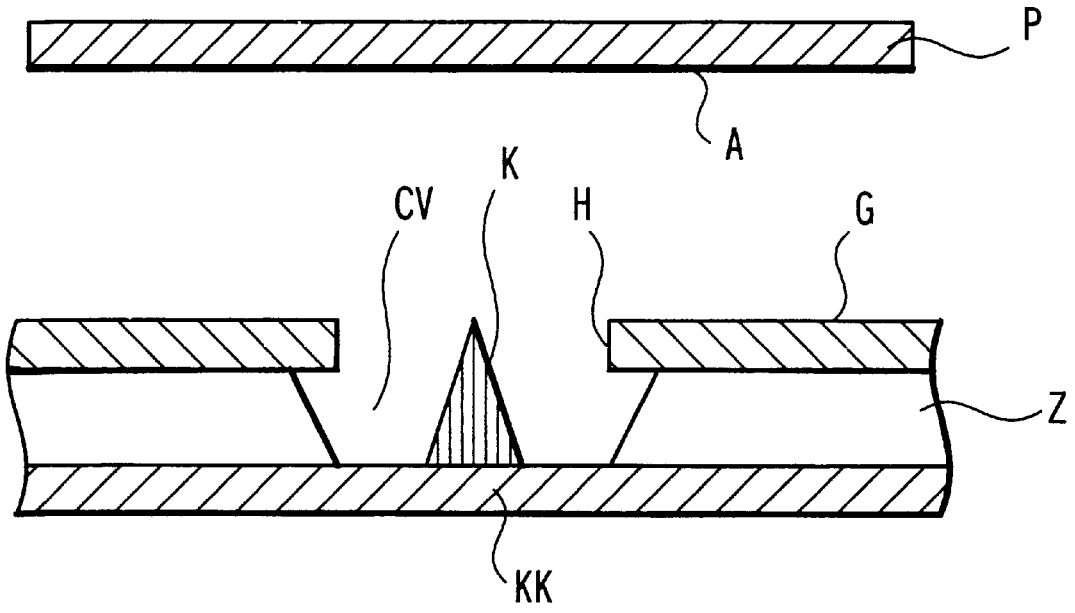
FIG. 2 is a cross-section view of a part of the conventional plane type displaying apparatus.

Then, the principle of the present invention is such that a strong electric field is constantly applied to the cathode K so that the Schottky barrier becomes smaller (refer to FIG. 10) and by changing over whether or not the ground electric potential is applied to the cathode K with the ON or OFF of the MOS gate MG, the presence or absence of the electron emission from the cathode K is controlled. On the other hand, in the conventional plane type displaying apparatus explained by referring to FIG. 1 and FIG. 2, by changing over whether or not to apply, for example, a voltage of +100V between the gate (drawer electrode) G and the cathode K, that is, by changing over the magnitude of the electric field applied to the cathode K, the magnitude of the Schottky barrier of the cathode K is varied between small and large (refer to FIG. 10), thereby controlling the presence or absence of the electron emission from the cathode K.

Figure 9:
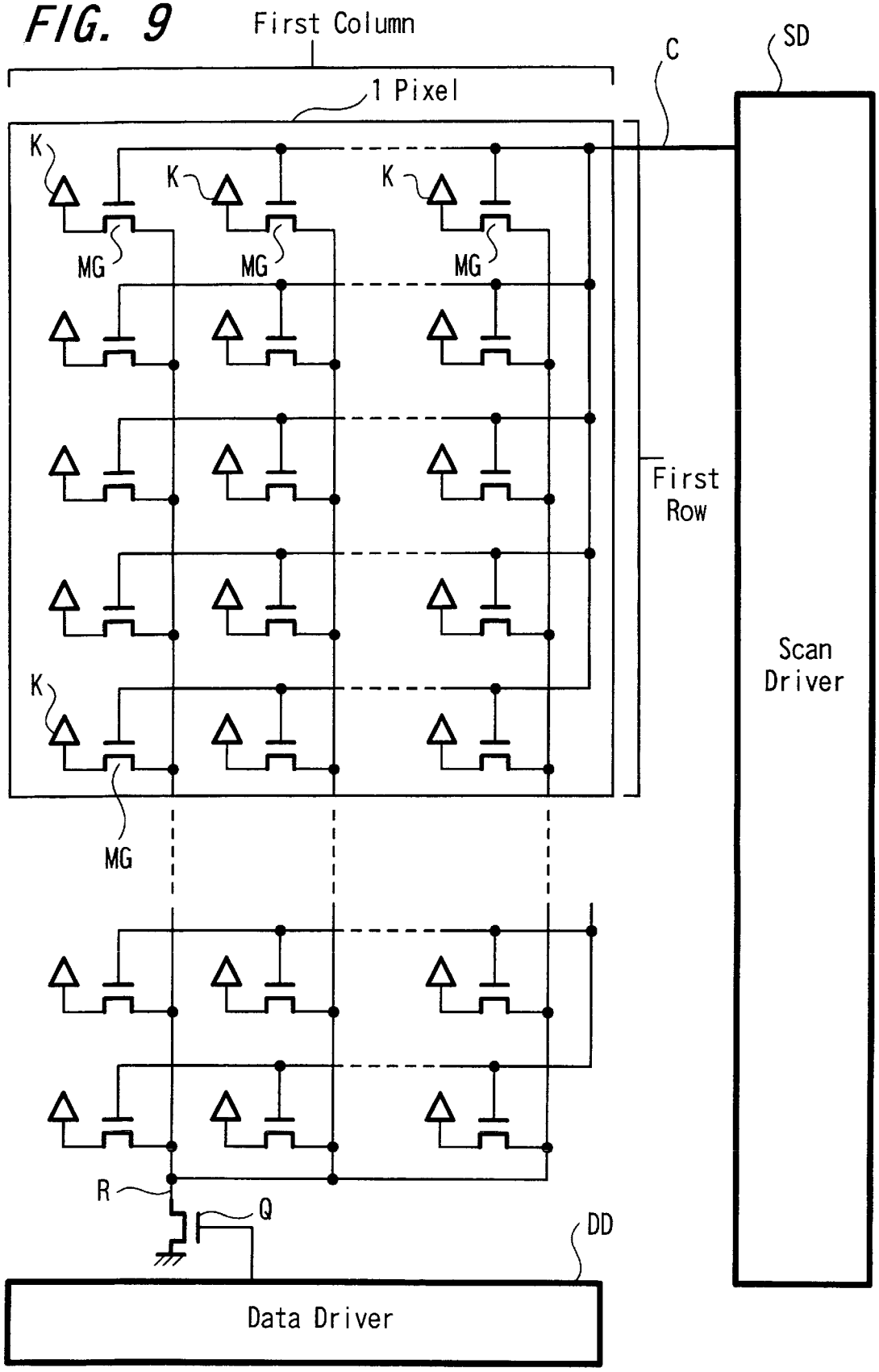
FIG. 9 is a block diagram showing a detail of a modified example of the gate array in the concrete example 1.

In the gate array of the concrete example 1 in FIG. 7, the respective column lines R are selectively grounded within the data driver DD depending on an image to be displayed, but it is recommendable that, as shown in FIG. 9, the respective column lines R are grounded through the drain and source of an n channel MOS transistor (MOS electric field effect transistor) Q and a pulse voltage with, for example, a crest value of 5V is applied to the gate of the MOS transistor Q connected to the column line R selected by the data driver DD to put the MOS transistor Q in an ON state, thereby grounding the selected column line R.

Figure 11:
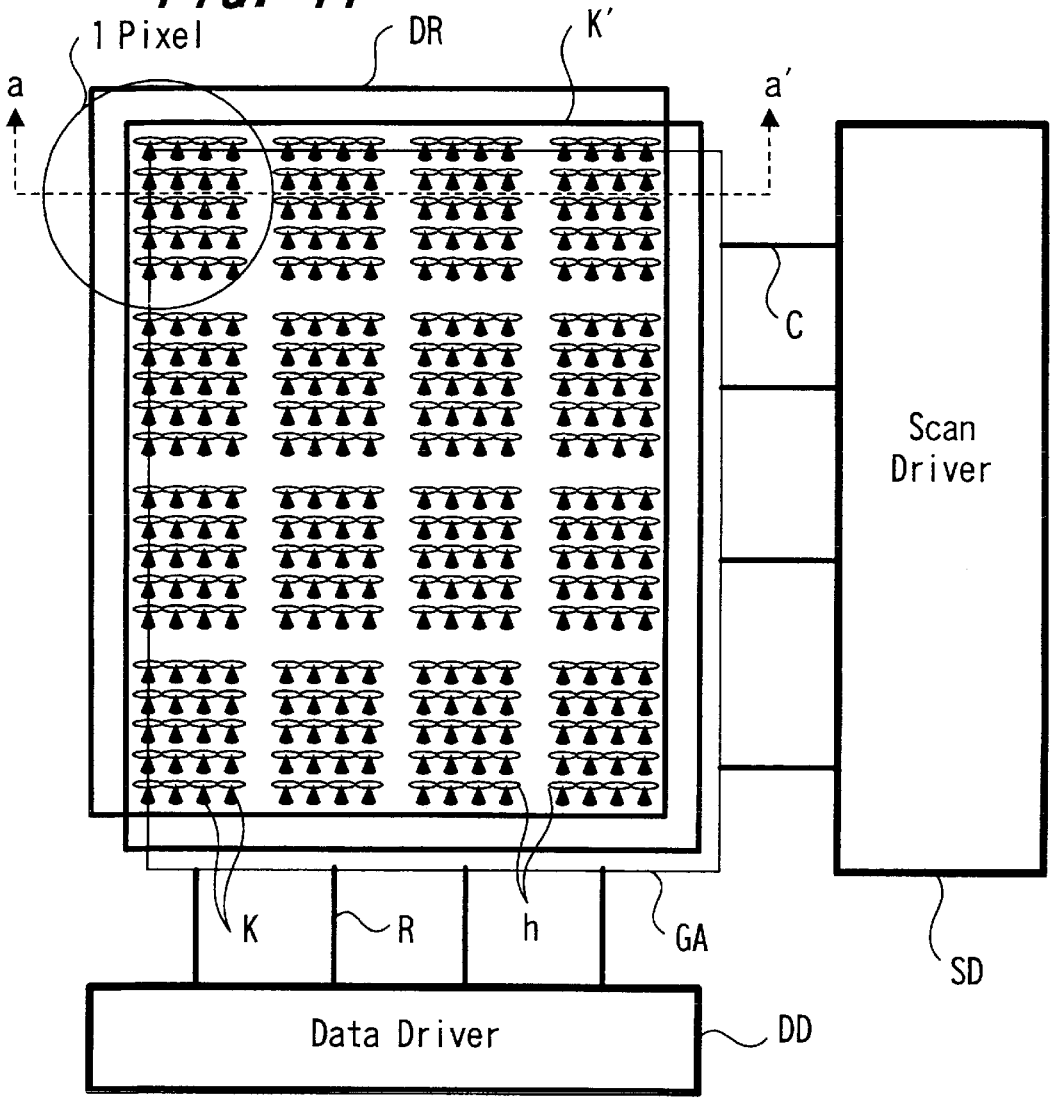
FIG. 11 is a block diagram showing a plane type displaying apparatus of a concrete example 2 according to the embodiment of the present invention.
Figure 12:
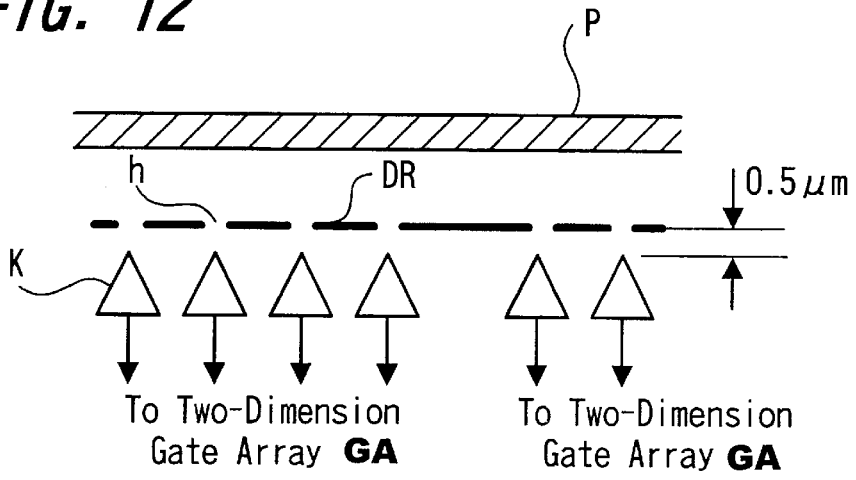
FIG. 12 is a cross-section view taken on line α–α' of FIG. 5 showing an electrode in the concrete example 2.

Next, by referring to FIG. 11 and FIG. 12 showing an electrode taken on line α–α' of FIG. 11, the plane type displaying apparatus of a concrete example 2 will be explained. The concrete example 2 is a case wherein a drawer electrode DR is, instead of the anode electrode A in the concrete example 1, provided in the vicinity of the respective cathodes K of the cathodes group K'. At a portion of the drawer electrode DR opposing each of cathodes K is bored a circular hole h. A space between each of the cathodes and the drawer electrode DR is set at, for example, 5 μm and a direct current (fixed voltage) of, for example, 100V is applied to the drawer electrode DR. Then, the respective cathodes K are connected to the drains of the respective MOS gates MG of the two-dimensional gate array GA as are the cases of FIG. 6~FIG. 8 in the concrete example 1. Since the operation and arrangement of the two-dimensional gate array GA are the same as in FIG. 6~FIG. 8, an overlapping explanation thereof will be omitted. Meanwhile, the fluorescent substance layer P is provided opposing the drawer electrode DR.

In the case of the concrete example 2, since the drawer electrode DR is provided in the vicinity of the cathode K in place of the anode electrode, a voltage of the high-tension electrode can be made lower in comparison with the concrete example 1.

Figure 13:
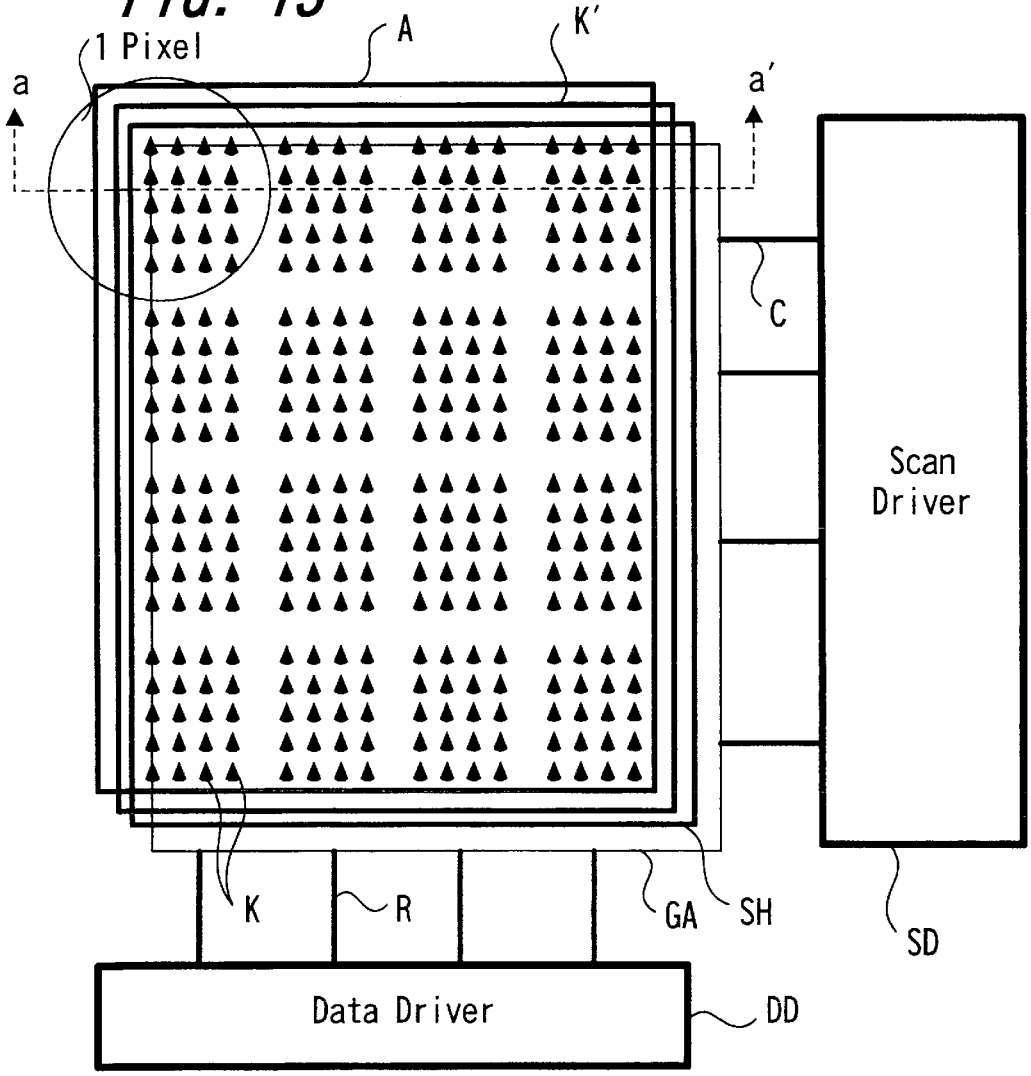
FIG. 13 is a block diagram showing a plane type displaying apparatus of a concrete example 3 according to the embodiment of the present invention.
Figure 14:
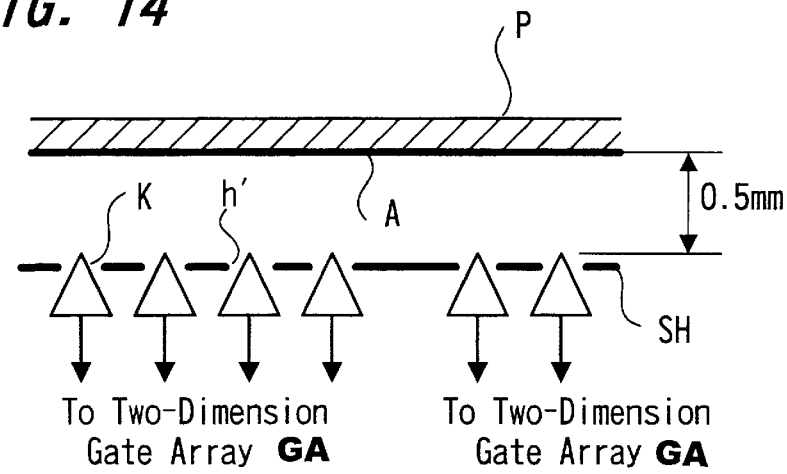
FIG. 14 is a cross-section view taken on line α–α' of FIG. 6 showing an electrode in the concrete example 3.

Next, with reference to FIG. 13 and FIG. 14 showing the electrode taken on line α–α' of FIG. 13, the plane type displaying apparatus of a concrete example 3 will be explained. The plane type displaying apparatus in the concrete example 3 is a case wherein a shield electrode SH common to the respective cathodes K of the cathodes group K' is provided in the plane type displaying apparatus of the concrete example 1. The shield electrode SH is provided with a circular hole h' through which the tip end of each of the cathodes K projects, and is given, for example, 0V. Meanwhile, the distance between the anode electrode A to which a direct current of 3 kv is applied and the tip end of the cathode K is, for example, 0.5 mm.

An electric potential distribution in the vicinity of the cathode K in the plane type displaying apparatus of the concrete example 1 is what is shown as an equipotential line EV in FIG. 8. In this case, the distance between the tip end of the cathode electrode K and the wiring W1 is, for example, 5 μm.

Figure 15:
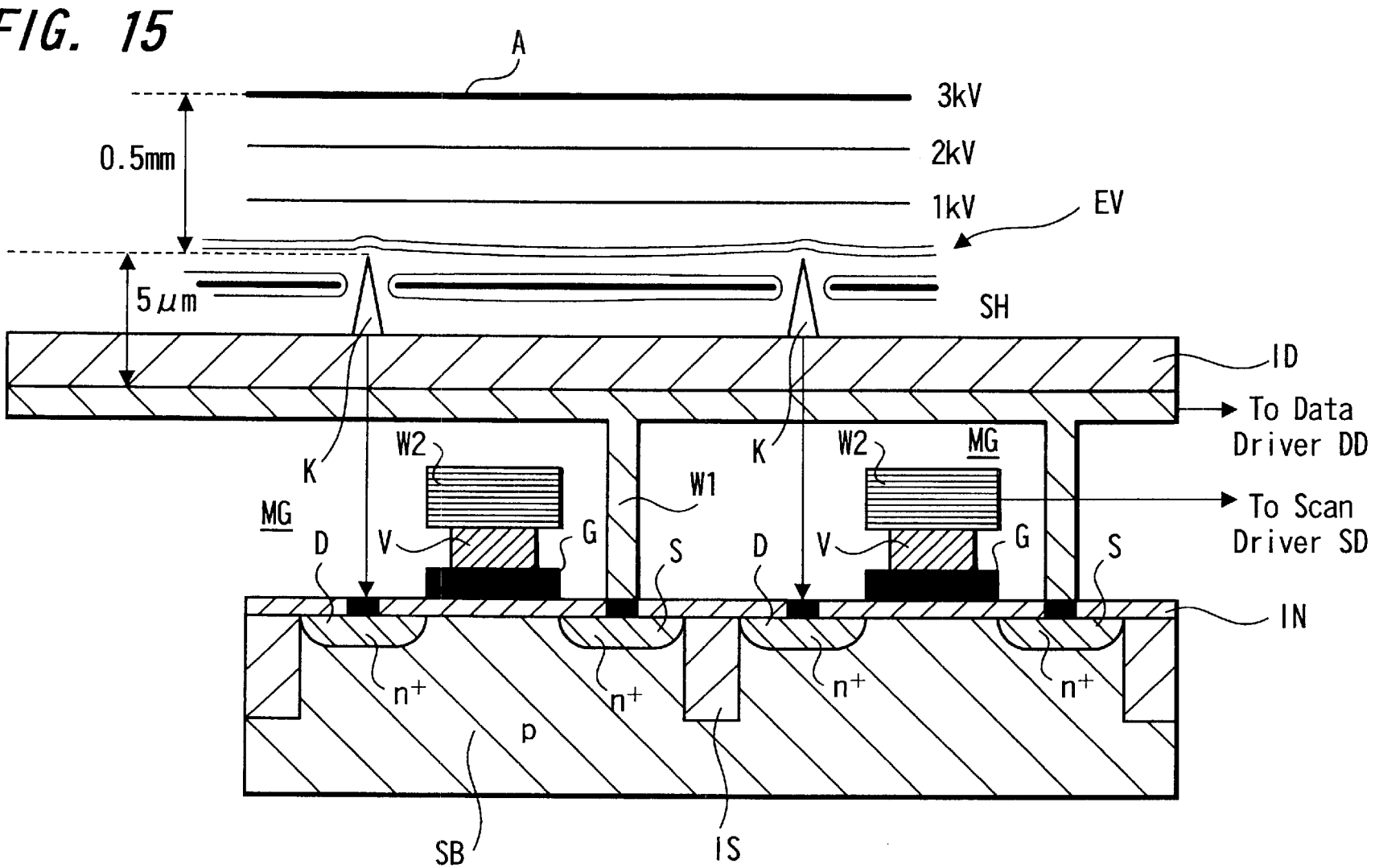
FIG. 15 is a cross-section view showing a structure in the vicinity of an MOS gate and a distribution of an electric potential in the vicinity of a cathode, in the concrete example 3.

On the other hand, an electric potential distribution in the vicinity of the cathode K in the plane type displaying apparatus of the concrete example 3 is such that, since the high voltage electric field from the anode electrode A is shielded by the shield electrode SH shown as an equipotential line EV in FIG. 15, although a voltage applied to the drain D of the MOS gates MG rises to 30V even when the MOS gates MG are OFF in FIG. 8, but lowers to about 3V in FIG. 15, there is little fear of the MOS gates MG being destructed. The fact that the operating voltage of the MOS gates MG is low is indispensable to compatibility of a high speed operation and lower power consumption by the plane type displaying apparatus of this kind, but the fact that the operating voltage is low means lowering of a dielectric withstand voltage. However, in the case of the concrete example 3, even when an MOS transistor with the operating voltage of as low as 5V is used, it is possible to keep the practical dielectric withstand voltage of the MOS transistor below the dielectric withstand voltage (10~15V) which the MOS transistor originally has.

Figure 16:
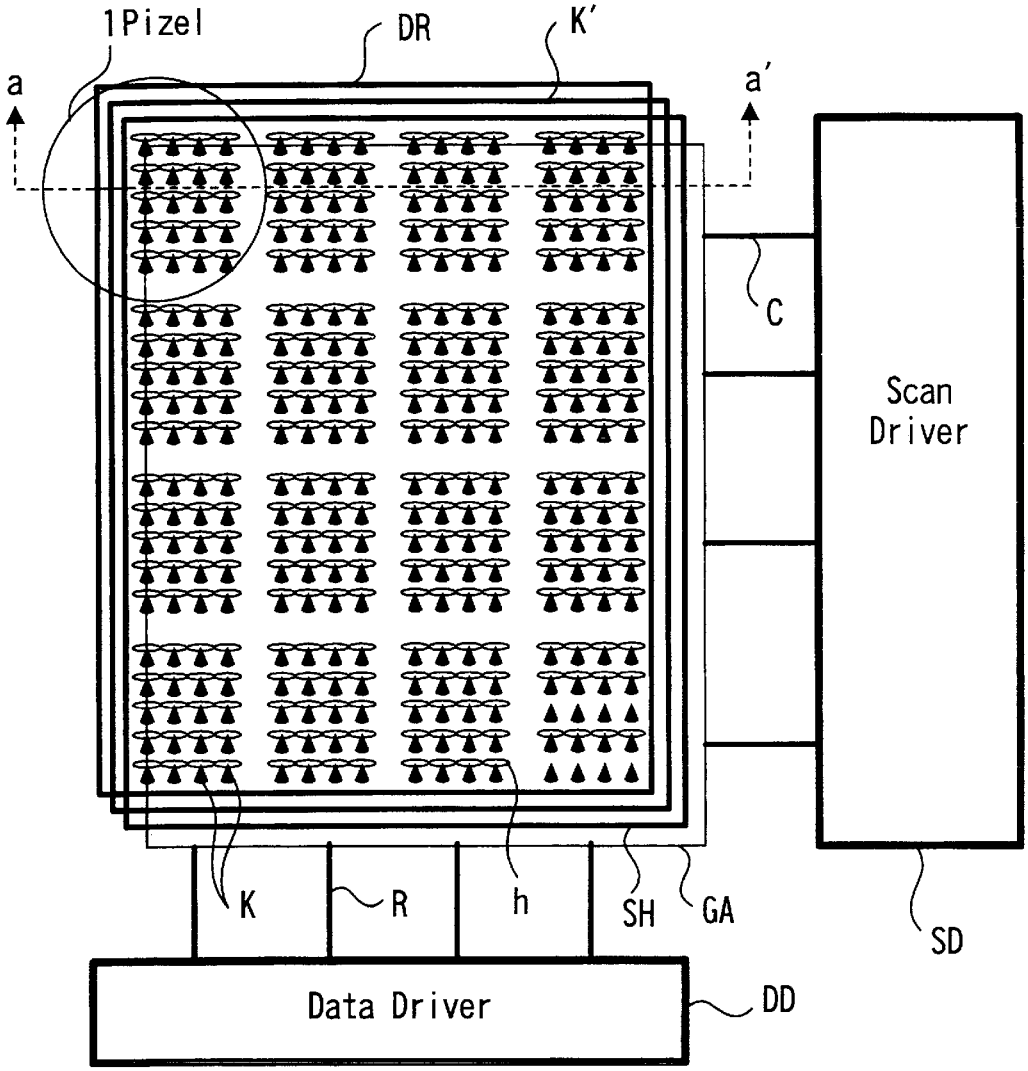
FIG. 16 is a block diagram showing a plane type displaying apparatus of a concrete example 4 according to the embodiments of the present invention.
Figure 17:
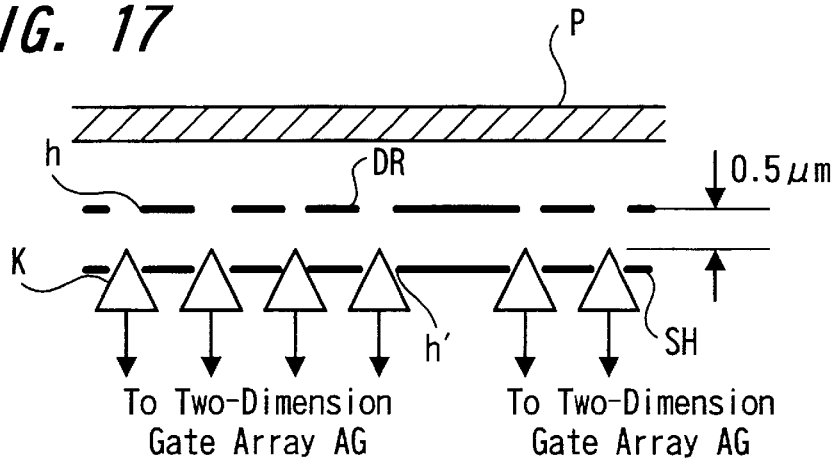
FIG. 17 is a cross-section view taken on line α–α' of FIG. 6 showing an electrode in the concrete example 4.

Next, with reference to FIG. 16 and FIG. 17 showing an electrode taken on line α–α' of FIG. 16, a plane type displaying apparatus of a concrete example 4 will be explained. In the concrete example 4, the similar shield electrode SH as in the concrete example 3 is provided in the plane type displaying apparatus of the concrete example 2. The other arrangement and operations are the same as in the concrete examples 2 and 3.

Figure 3:
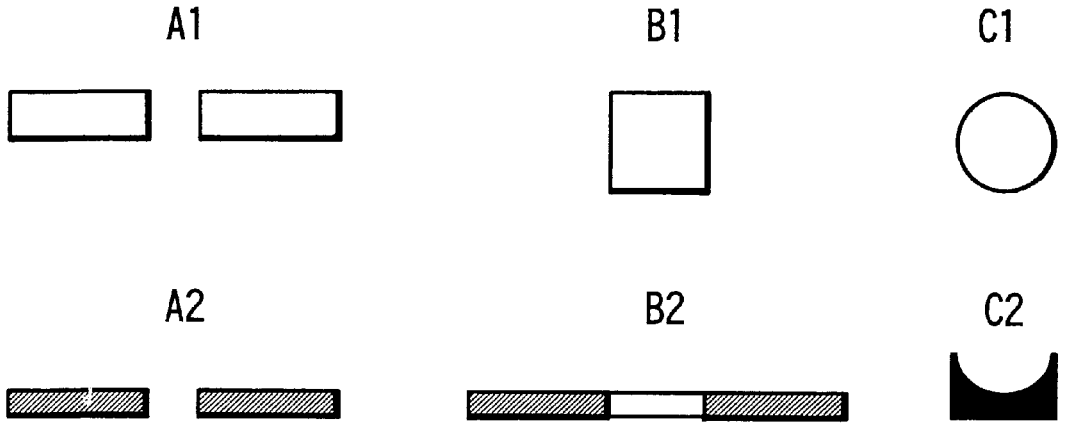
FIG. 3 is a plan view and a cross-section view showing an example of an electric field emitting type cathode of the conventional plane type displaying apparatus.

Meanwhile, in the above-mentioned respective concrete examples, a shape of the cathode K such as shown in the above-mentioned FIG. 3 as well as an MIM type electron emitting element formed of metal/insulating layer/metal and the like are possible.

In the above-mentioned respective concrete examples, mention was made of the case wherein the n channel type MOS transistor was used as the MOS gate, but it is possible to use a p channel type MOS transistor.

According to the first aspect of the present invention, in the plane type displaying apparatus having the plurality of the electric field emitting type cathodes and the fluorescent substance layer made to luminesce by the bombarding of the electron emitted from the electric field emitting type cathode selected from among the plurality of the electric field emitting type cathodes, since it is comprised of the plurality of electric field emitting type cathodes, the high-tension electrode which fixedly gives on the surface of the plurality of the electric field emitting type cathodes the strong electric field forming the Schottky barrier capable of emitting the electrons from the plurality of the electric field emitting type cathodes, the two-dimensional MOS gate array which is connected to the plurality of the electric a field emitting type cathodes and controls the presence or absence of the electron emission from the plurality of the electric field emitting type cathodes, and the fluorescent substance layer made to luminesce by the bombarding of the electron selectively emitted from among the plurality of the electric field emitting type cathodes, it is possible to obtain the plane type displaying apparatus capable of reducing the driving voltage for having the plurality of the electric field emitting type cathodes selectively emit the electron, the power consumption as well as performing the high speed operation.

According to the second feature of the present invention, since there are comprised of: the electric field emitting type cathode group wherein the pixels, each of them consisting of the electric field type emitting cathodes disposed in a matrix of m rows by n columns (however, m, n are integers equal to or larger than 1) are disposed in a matrix of M rows by N columns (however, M, N are integers equal to or larger than 2), the high-tension electrode which fixedly gives the strong electric field forming the Schottky barrier capable of making possible the electron emission from each electric field emitting type cathode on the surface of each electric field type cathode forming the electric field emitting type cathode group, the two-dimensional MOS gate array consisting of the MOS gates of which each of the electric field emitting type cathodes forming the electric field emitting type cathode group is connected to each drain, the scan driving means which successively and cyclically applies the pulse voltage to the gate of each MOS gate connected to each electric field emitting type cathode in the pixels of M rows at every row in M rows that turns on each MOS gate, the image data driving means which, in synchronism with the pulse voltage generated from the scan driving means applies selectively and simultaneously the low voltage to the source of each MOS gate connected to each electric field emitting type cathode in the pixels of N columns depending on the image to be displayed at every N column, and the fluorescent substance layer made to brighten by the bombarding of the electrons selectively emitted from the electric field emitting type cathode at every pixel, in the plane type displaying apparatus having the electric field emitting type cathode group wherein the pixels, each of them consisting of the electric field type emitting cathodes disposed in a matrix of m row by n column (however, m, n are integers equal to or larger than 1) are disposed in a matrix of M rows by N columns (however, M, N are integers equal to or larger than 2) and the fluorescent substance layer made to brighten by the bombarding of the electrons emitted from the electric field emitting type cathode at every pixel of the electric field emitting type cathodes group, it is possible to reduce the driving voltage for having the electric field emitting type cathode group selectively emit the electrons at every pixel, the power consumption and at the same time, to obtain the plane type displaying apparatus capable of carrying out the high speed operation.

According to the third feature of the present invention, in the plane type displaying apparatus of the first present invention, since the high-tension voltage is the anode electrode wherein the fluorescent layer are formed, it is possible to obtain the plane type displaying apparatus of a simple arrangement in addition to the effect of the first present invention.

According to the fourth aspect of the present invention, in the plane type displaying apparatus of the 1st present invention, since the high-tension voltage is the drawer electrode provided in the vicinity of the plurality of electric field emitting type cathodes, it is possible to obtain the plane type displaying apparatus capable of reducing the high voltage of the high-tension electrode in addition to the effect of the first present invention.

According to the fifth feature of the present invention, in the plane type displaying apparatus of the first plane type displaying apparatus, since the shield electrode is provided in the vicinity of the plurality of electric emitting type cathodes, it is possible to obtain the plane type displaying apparatus in which, in addition to the effect of the first present invention, there is no fear of the high-tension voltage being applied to the MOS gate, thereby making it possible to avoid the destruction of the MOS gate.

According to the sixth feature of the present invention, in the plane type displaying apparatus of the fifth feature of the present invention, since the voltage nearly equivalent to the low voltage selectively applied to the plurality of electric field emitting type cathodes or the voltage lower than the low voltage is to be applied to the shield electrode, it is possible to obtain the plane type displaying apparatus capable of obtaining the same effect of the fifth feature of the present invention.

According to the seventh aspect of the present invention, in the plane type displaying apparatus of the fifth feature of the present invention, since the voltage nearly equivalent to the low voltage selectively applied to the plurality of electric field emitting type cathodes or the voltage lower than the low voltage is to be applied to the shield electrode when the MOS gate is at least OFF, it is possible to obtain the plane type displaying apparatus capable of obtaining the same effect of the fifth feature of the present invention.

According to the eighth aspect of the present invention, in the plane type displaying apparatus of the second feature of the present invention, since the high-tension electrode is the anode electrode wherein the fluorescent substance layer is formed, it is possible to obtain the plane type displaying apparatus of a simple arrangement in addition to the effect of the second feature of the invention.

According to the ninth aspect of the present invention, in the plane type displaying apparatus of the second feature of the present invention, since the high-tension voltage is the drawer electrode provided in the vicinity of the electric field emitting type cathodes group, it is possible to obtain the plane type displaying apparatus capable of reducing the high-tension voltage in addition to the effect of the second feature of the present invention.

According to the tenth aspect of the present invention, in the plane type displaying apparatus of the second feature of the present invention, since the shield electrode is provided in the vicinity of the electric emitting type cathodes group, it is possible to obtain the plane type displaying apparatus in which, in addition to the effect of the second feature of the present invention, there is no fear of the high-tension voltage being applied to the MOS gate, thereby making it possible to avoid the destruction of the MOS gate.

According to the eleventh aspect of the present invention, in the plane type displaying apparatus of the tenth aspect of the present invention, since the voltage nearly equivalent to the low voltage selectively applied to the plurality of electric field emitting type cathodes or the voltage lower than the low voltage is to be applied to the shield electrode, it is possible to obtain the plane type displaying apparatus capable of obtaining the same effect of the tenth present invention.

According to the twelfth aspect of the present invention, in the plane type displaying apparatus of the tenth aspect of the present invention, since the voltage nearly equivalent to the low voltage selectively applied to the plurality of electric field emitting type cathodes or the voltage lower than the low voltage is to be applied to the shield electrode when the MOS gate is at least OFF, it is possible to obtain the plane type displaying apparatus capable of obtaining the same effect of the tenth aspect of the present invention.

Having described preferred embodiments of the present invention with reference to the accompanying drawings, it is to be understood that the present invention is not limited to the a above-mentioned embodiments and that various changes and modifications can be effected therein by one skilled in the art without departing from the spirit or scope of the present invention as defined in the appended claims.

What is claimed is:

1. A plane type displaying apparatus, comprising:

a plurality of electric field emitting type cathodes, a high-tension electrode which fixedly gives on a surface of said plurality of electric field emitting type cathodes a strong electric field forming a Schottky barrier capable of making possible electron emission from said plurality of electric field emitting type cathodes, a two-dimensional MOS gate array which is connected to said plurality of electric field emitting type cathodes and controls presence or absence of the electron emission from said plurality of electric field emitting type cathodes, and a fluorescent substance layer made to brighten by bombarding of the electrons selectively emitted from among said plurality of electric field emitting type cathodes.

2. In a plane type displaying apparatus as claimed in claim 1, being characterized in that said high-tension electrode is an anode electrode wherein said fluorescent substance layer is formed.

3. A plane type displaying apparatus as claimed in claim 1, being characterized in that said high-tension electrode is a drawer electrode provided in the vicinity of said plurality of electric field emitting type catqhodes.

4. A plane type displaying apparatus as claimed in claim 1, being characterized in that a shield electrode is provided in the vicinity of said plurality of electric field emitting type cathodes.

5. A plane type displaying apparatus as claimed in claim 4, being characterized in that, a voltage nearly equivalent to a low voltage selectively applied to said plurality of electric field emitting type cathodes or lower than said low voltage is made to be applied to said shield electrode.

6. A plane type displaying apparatus as claimed in claim 4, being characterized in that a voltage nearly equivalent to a low voltage selectively applied to said plurality of electric field emitting type cathodes or lower than said low voltage is made to be applied to the shield electrode when at least said MOS gate is OFF.

7. A plane type displaying apparatus, comprising:

an electric field emitting type cathode group wherein pixels, each of them consisting of electric field emitting type cathodes disposed in a matrix of m rows by n columns (however, m, n are integers equal to or larger than 1), are disposed in a matrix of M rows by N columns (however, M,N, are integers equal to or larger than 2), a high-tension electrode which fixedly gives on a surface of each of electric field emitting type cathodes forming said electric field emitting type cathode group a strong electric field forming a Schottky barrier capable of making possible the electron emission from each of said electric field emitting type cathodes, a two-dimensional MOS gate array consisting of MOS gates to drains of which respective electric field emitting type cathodes forming said electric field emitting type cathodes group are respectively connected, a scan driving means for successively and cyclically applying, at every row of said M rows, a pulse voltage to gates of respective MOS gates connected to respective electric field emitting type cathodes in said M rows of pixels for making said MOS gates ON, an image data driving means which, in sychronism with said pulse voltage generated from said scan driving means selectively and simultaneously applies at every column in said N columns a low voltage to sources of respective MOS gates connected to respective electric field emitting type cathodes in said N columns of pixels in accordance with an image to be displayed, and a fluorescent substance layer made to brighten by bombarding of electrons selectively emitted from said electric field emitting type cathodes at said every pixel.

8. A plane type displaying apparatus as claimed in claim 7, being characterized in that said high-tension electrode is an anode electrode wherein said fluorescent substance layer is formed.

9. A plane type displaying apparatus as claimed in claim 7, being characterized in that said high-tension voltage is a drawer electrode provided in the vicinity of said electric field emitting type cathodes group.

10. A plane type displaying apparatus as claimed in claim 7, being characterized in that a shield electrode is provided in the vicinity of said electric emitting type cathode group.

11. A plane type displaying apparatus as claimed in claim 10, being characterized in that a voltage nearly equivalent to a low voltage selectively applied to said plurality of electric field emitting type cathodes or lower than said low voltage is made to be applied to said shield electrode.

12. A plane type displaying apparatus as claimed in claim 10, being characterized in that a voltage nearly equivalent to a low voltage selectively applied to the electric field emitting type cathodes of said electric field emitting type cathode group or lower than said low voltage is made to be applied to said shield electrode when at least said MOS gate is OFF.

* * * * *

UNITED STATES PATENT AND TRADEMARK OFFICE

CERTIFICATE OF CORRECTION

PATENT NO. : 6,340,962 B1
DATED : January 22, 2002
INVENTOR(S) : Morikazu Konishi It is certified that error appears in the above-identified patent and that said Letters Patent is hereby corrected as shown below:

Column 11,
Line 41, replace “catqhodes” with -- cathode --.

Signed and Sealed this

Fourth Day of February, 2003

JAMES E. ROGAN
*Director of the United States Patent and Trademark Office*